United States Patent [19]

Lipschutz

[11] 3,974,348

[45] Aug. 10, 1976

[54] REVERSING SWITCH CONTROLLED BY A SAFETY LOCK HAVING A CYLINDRICAL BARREL

[75] Inventor: Paul Lipschutz, Croissy-Sur-Seine, France

[73] Assignee: Societe d'Exploitation des Brevets Neiman SA, Courbevoie, France

[22] Filed: Jan. 23, 1975

[21] Appl. No.: 543,212

[30] Foreign Application Priority Data

Feb. 14, 1974 France ..... 74.04952

[52] U.S. Cl. ..... 200/44; 200/11 C

[51] Int. Cl.[2] ..... H01H 27/00

[58] Field of Search ..... 200/44, 153 V, 155 R, 200/11 C, 61.58 R, 61.64, 61.67, 42 R, 42 A, 237–250; 70/DIG 30, 252; 307/10 R, 10 AT

[56] References Cited

UNITED STATES PATENTS

| | | | |
|---|---|---|---|
| 3,310,642 | 3/1967 | Zeller | 200/44 |
| 3,629,530 | 12/1971 | Fischer | 200/44 |
| 3,639,708 | 2/1972 | Wolniak | 200/11 K |
| 3,793,497 | 2/1974 | DiGaetano | 307/10 AT |

*Primary Examiner*—Robert K. Schaeffer
*Assistant Examiner*—M. Ginsburg
*Attorney, Agent, or Firm*—Nolte and Nolte

[57] ABSTRACT

A switch is disclosed which comprises a rockable switch actuating element having contacts and a fixed switch terminal means. The rockable element is moved by operation of a lock of which the rotor has an eccentric extension disposed within and cooperating with an opening in said rockable actuating member so that upon insertion of the key into the rotor and turning of that rotor, the actuating element is moved to effect switching.

8 Claims, 6 Drawing Figures

REVERSING SWITCH CONTROLLED BY A SAFETY LOCK HAVING A CYLINDRICAL BARREL

The generalized use of a system for simultaneously opening or closing a plurality of vehicle doors or bonnets gives rise to a problem of a safety lock capable of sending electric pulses to solenoids or relays for remote controlling the unlocking or locking of said doors or bonnets.

In order to satisfy this new need it was necessary to design a switch which can be housed in the space provided, in shape in volume, for a conventional door lock.

An object of the present invention is to provide a solution to this problem.

The latter requires firstly the coexistence within a small space of a barrel-type safety lock having tumblers or pistons, and a switch, the assembly having great strength and high efficiency and the electrical part being, and remaining, designed and constructed to avoid any accidental short circuiting and grounding. These two mechanical and electrical elements must have, separately and in combination, an exceptional reliability owing to the conditions of utilisation: high stresses due to deformation of the door and body; jolts and shocks notwithstanding improved vehicle suspensions; sometimes violent actuation of the closing means by the users when getting in or out of the vehicle or when loading or unloading goods.

An object of the present invention is to satisfy all these conditions and also to enable the lock to open mechanically at least one of the doors or bonnets of the vehicle in the event of failure of the electrical equipment.

Another feature of the invention is to permit the replacement of an non-electrified existing lock by the proposed lock with its integrated switch.

A new feature of the invention is that it is possible to send out by shifting the key, in door or bonnet control circuits electric pulses in one direction or the other, the key returning automatically to the zero position as soon as it is left in one of the operative positions. Thus the pulses may be as short as desired while allowing high energizing currents of very short duration in the control electromagnets.

By way of an example to which the invention is not intended to be limited, there will now be described the application of the invention to a lock having a cylindrical barrel represented as being a tumbler lock; but it will be understood that the application of the invention to a lock having pistons in no way changes the features of the proposed device. The same is true of its application to any other compact lock having strips for example that described in French Pat. Nos. 2,185,096 filed May 17, 1972 and its first Addition 73/18 510 filed May 22, 1973 by the same inventor. The transposition of the invention to either of the types of compact locks does not modify the essential features thereof.

Reference will be made to FIGS. 1 to 6 of the accompanying single sheet of drawing in which.

Figure 1:
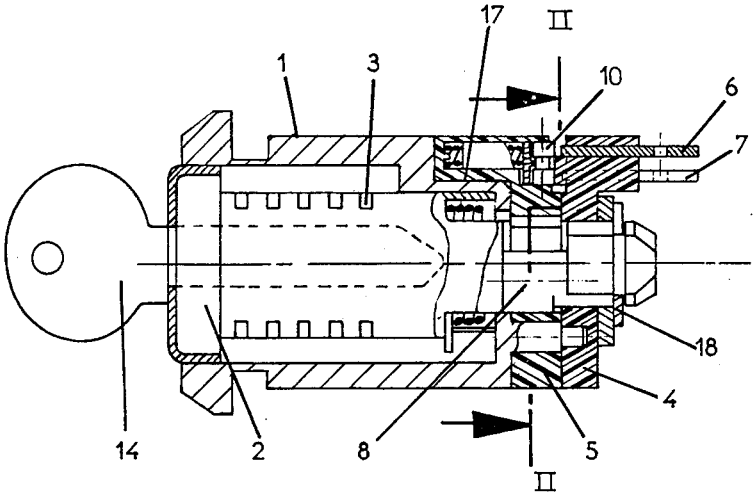
FIG. 1 is an axial, longitudinal, sectional view of the lock-switch assembly, with the barrel and key not shown in section, in the position of an "open contact", the switch being in the zero or neutral position.

FIG. 1 shows a stator 1 of the lock made from cast, press-formed or forged material which receives the assembly of the cylindrical barrel and switch and is adapted to be fixed in the conventional housing provided on the door or the bonnet. This stator has in section the very elaborate general shape shown in FIG. 2 and is provided with centering and keying means as shown in FIG. 3 to prevent it from rotating in its housing (see the flange 30 and lug 31).

This stator 1 receives a rotor 2 which is flush with the flange of the stator 1 and is provided with a barrel having tumblers such as 3 which only allow rotation by a key 14 which is designed in accordance with the code of the lock.

The rotor 2 is extended in the rear part by an eccentric 8, whose function will be explained hereinafter, and an optional drive device 19 for actuating associated equipment.

The eccentric 8 is movable in an opening 8' formed in the insulating pivotable part 5 of the switch, which part pivots about a pin 9 fixed in the stator 1.

Assembled with this pivoting part, an insulating stator 4, positioned by the pivot pin 9, is fixed to the stator on the parts 20 and 20' as shown in FIG. 3 and is provided in its upper part with conductive strips 6, 7 and 7' which are for example moulded into their fixed positions, the inner ends of which strips form three semicircular tracks concentric with the pivot pin 9. These three tracks are, on the front face of the insulating stator 4, flush with an insulating boss 13 shown in FIG. 4.

Figure 6:
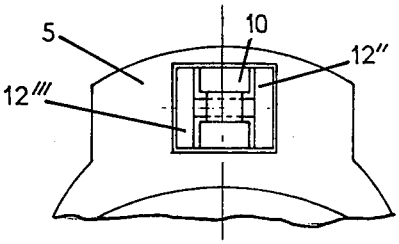
FIG. 6 is a cross-sectional view, taken on line VI—VI of FIG. 5, of the contact element and its drive by means of the insulating rotor.

Rollable along the active part of the strips 6, 7 and 7' is a conductive rocker 10, in the shape of a diabolo, driven as shown in FIG. 6 by the end of the pivotable part 5 through the sides 12'' and 12''' of a shoe 12 without any attachment to this part.

Thus the rocker 10, driven by the part 5, can put the track 6 in contact with the track 7 (clockwise direction) or the track 6 in contact with the track 7' (counter clockwise direction) and of course likewise interconnect the conductive strips having the same references 6 and 7 or 6 and 7' depending on the direction in which the key 14 and the barrel 2 of the lock are turned.

Figure 5:
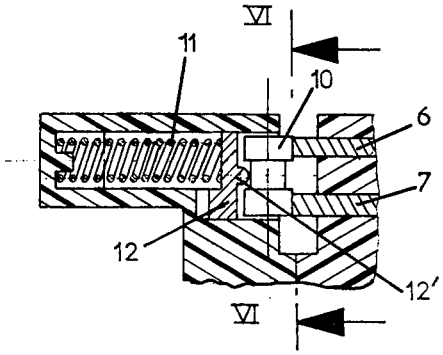
FIG. 5 is an enlarged longitudinal sectional view of a detail of the switch.

In order to ensure a good contact with the conductive tracks, the rocker 10 is biased towards these tracks by the pivot shoe 12 shown in FIGS. 5 and 6 which has for this purpose a central boss 12' and is itself biased by a compression spring 11 towards said strips. The spring 11 is disposed in a cavity in the pivoting part 5.

Figure 2:
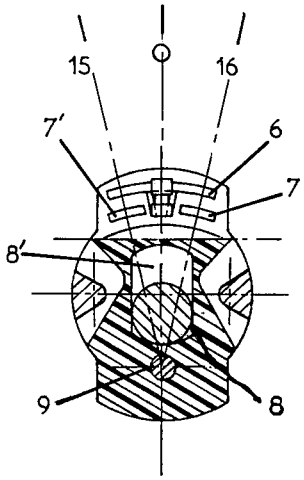
FIG. 2 is a cross-sectional view taken on the zig-zag line II—II of FIG. 1 in the zero position of the assembly.
Figure 3:
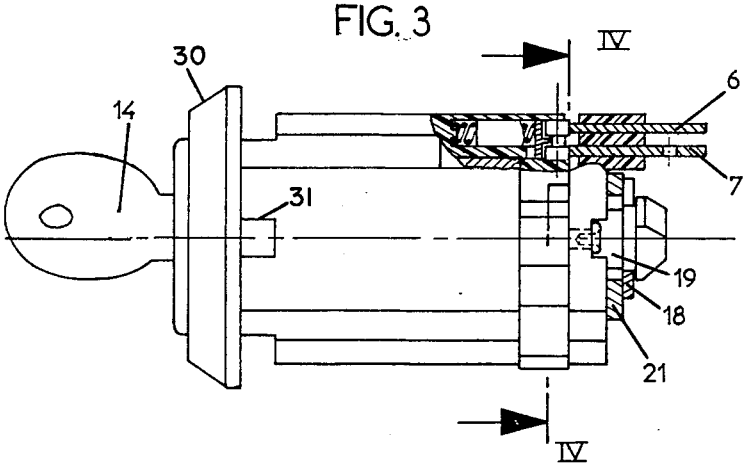
FIG. 3 is a partial, axial, longitudinal, sectional view of the lock-switch assembly, the key having just been turned in the clockwise direction to one of the operative "closed contact" position.

The insulating boss 13 disposed under the strip 6 has for effect to facilitate the passage of the rocker 10 from the neutral point 0 to the position 15 or 16 shown in FIG. 2 and to keep the rocker steady about the boss 12'. At the same time it serves to break the spark which might be produced when the rocker rapidly leaves the track 7 or 7'.

A bi-directional torsion spring 17 ensures the return of the rocker to the neutral position 0 shown in FIGS.

1 and 2 and at the same time the return of the pivotable part 5 to the same position 0.

A fixing clip 18 ensures the assembly of the moving part as soon as the latter has been fitted with the insulating rotor 5 and the insulating stator 4. A bearing portion provided at the end of the rotor can receive a mechanical control lever 21 for opening the door.

Figure 4:
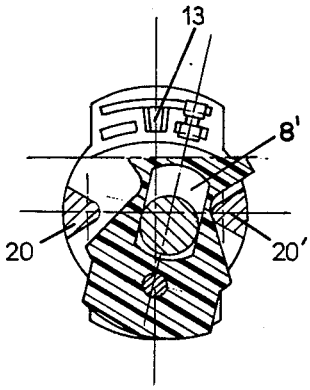
FIG. 4 is a cross-sectional view taken on line IV—IV of FIG. 3.

Two abutments 20 and 20′ provided on the stator 4 limit the extent of the rotation of the part 5 in either direction, complementary notches being provided on this part as shown in FIGS. 2 and 4.

The operation of the device is self explanatory, bearing in mind that the switch can occupy the three positions indicated in FIG. 2 by the reference axes 0, 15 and 16.

When the lock is actuated by the suitable key 14 and the rotor 2 is rotated to the right for example, the rotor, engaged by its eccentric 8 in the opening 8′ of the pivotable part 5, pivots the latter about its pin 9 until the abutment 20′ on the part 4 is reached.

This part 5 drives the rocker 10 which moves from the neutral position shown in FIGS. 1 and 2 to the operative position 16 shown in FIG. 4 and thus closes the contact between the strips 6 and 7 and produces current in the required direction to actuate the door-opening solenoids. When the operation has finished, the key 14 is released and the rotor 2 returns on its own to the neutral point 0 under the action of the spring 17.

The force exerted by the driver on the key and the whole of the device to obtain the aforementioned result is reduced to a minimum by the combination of the devices employed, namely:

a. The eccentric whose force is increased by the ratio of the leverages of the part 5 pivoted at 9, the resistance represented by the resistance to rolling of the rocker 10 being exerted at the driving end of the part 5.

b. The force required to roll the rocker 10 is reduced to a minimum by the arrangements adopted for the shape of said rocker and the driving thereof.

Moreover, the small extent of the rotation of the key reduces the operating time to the minimum necessary to produce in the circuits currents in the form of high-intensity pulses of very short duration.

The application of the invention is not necessarily limited to the direct electromagnetic control of the simultaneous openings and lockings of vehicle doors. It may encompass any control of the same type for mechanisms, which control is effected at the end of a system pneumatically or hydraulically, the electro magnets then being replaced by electrically-operated valves, which valves are in increasing use.

Owing to the low inertia and the low friction due to the design of the reversing switch according to the invention, even when it is miniaturized, its use does not substantially increase the time constant of the servo mechanism operated thereby.

I claim:

1. A switch comprising a lock, said lock having a stator, a cylindrical barrel rotatable within said stator about a first axis, an operating element integral with said barrel, said element extending parallel to and being offset from, said axis, a movable switch actuating element, switch contact means mounted on and movable with said actuating element, means mounting said switch actuating element for rocking movement about a second axis parallel to and offset from both said first axis and said operating element, said switch actuating element having an opening therein and said operating element always extending into that opening and coacting with marginal edges defining said opening during turning movement of said barrel to produce rocking movement of said switch actuating element, a fixed switch element, fixed switch terminal means mounted on said fixed switch element, said switch contact means of said actuating element cooperating with said terminal means, said second axis being disposed on one side of a diametral plane of said barrel normal to a plane including said first and second axes and said contact means and said terminal means being disposed on the opposite side of said diametral plane.

2. A switch as claimed in claim 1, wherein said switch actuating element is electrically insulating and pivotally mounted on a fixed pin integral with the stator.

3. A switch as claimed in claim 2 wherein said contact means comprises an electrically conducting rocker in the shape of a diabolo freely received in a recess in said actuating element and wherein spring biasing means are provided urging said rocker towards said terminal means.

4. A switch as claimed in claim 3 wherein said spring biasing means comprises a spring disposed in said recess and a shoe located between said spring and said rocker, said shoe including a raised rib bearing against a reduced section neck of said diabolo shaped rocker.

5. A switch as claimed in claim 1 wherein said switch contact means comprises a conducting element having enlarged end portions separated by a reduced sectioned neck portion, said element being freely received within a recess in said actuating element, said recess opening toward said terminal means, said end portions contacting said terminal means and means biasing said conducting element toward said terminal means.

6. A switch as claimed in claim 5 wherein said biasing means comprises a spring disposed in said recess and a shoe located between said spring and the conducting element, said shoe engaging said neck portion of said conducting element.

7. A switch comprising a key operated lock having a stator and a cylindrical rotor turnable about a first axis in the stator by a key, a rod-like operating element movable with said rotor and offset from said first axis, a switching contact, means mounting said switching contact to said stator for rocking movement about a second axis parallel to said first axis and offset from both said first axis and said operating element, switch terminals fixed relative to said stator and disposed to be contacted by said switching contact during rocking motion of said contact to complete a circuit, said switching contact comprising an opening and said operating element always extending into said opening and cooperating with marginal edges defining said opening during turning movement of said rotor to impart rocking movement to said switching contact, said terminals being disposed on one side of a diametral plane of said rotor normal to a plane including said first and second axes and said second axis being disposed on the opposite side of said diametral plane.

8. A switch as claimed in claim 7 wherein said rotor and with it said switching contact is resiliently biased to a rest position, said switching contact being isolated from said switch terminals in said rest position.

* * * * *